US009201330B2

(12) United States Patent
Koyama

(10) Patent No.: US 9,201,330 B2
(45) Date of Patent: Dec. 1, 2015

(54) DEVELOPER, METHOD FOR FORMING IMAGE, AND METHOD FOR PRODUCING DEVELOPER

(71) Applicant: KYOCERA Document Solutions Inc., Osaka (JP)

(72) Inventor: Akinori Koyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/451,593

(22) Filed: Aug. 5, 2014

(65) Prior Publication Data

US 2015/0044605 A1 Feb. 12, 2015

(30) Foreign Application Priority Data

Aug. 8, 2013 (JP) ..... 2013-165224

(51) Int. Cl.

| | |
|---|---|
| ***G03G 9/083*** | (2006.01) |
| ***G03G 13/095*** | (2006.01) |
| ***G03G 9/107*** | (2006.01) |
| ***G03G 9/08*** | (2006.01) |

(52) U.S. Cl.

CPC ..... *G03G 13/095* (2013.01); *G03G 9/0808* (2013.01); *G03G 9/107* (2013.01)

(58) Field of Classification Search

CPC ..... G03G 9/083; G03G 9/08728; G03G 9/08793; G03G 9/0817; G03G 13/08; G03G 13/095

See application file for complete search history.

(56) References Cited

FOREIGN PATENT DOCUMENTS

| | | | | |
|---|---|---|---|---|
| JP | S61-236560 A | | 10/1986 | |
| JP | 06016820 | * | 1/1994 | ..... C08G 63/12 |
| JP | 06016821 | * | 1/1994 | ..... C08G 63/12 |
| JP | 2005-202133 A | | 7/2005 | |
| JP | 2007-248547 A | | 9/2007 | |

OTHER PUBLICATIONS

Machine English language translation of JP 06016820 Jan. 25, 1994.*

Machine English language translation of JP 06016821 Jan. 25, 1994.*

* cited by examiner

*Primary Examiner* — Hoa V Le

(74) *Attorney, Agent, or Firm* — Studebaker & Brackett PC

(57) ABSTRACT

A developer of the present disclosure contains: toner particles each containing a binder resin and a magnetic powder; cross-linked polyester resin particles having a particle size of 2 μm or more and 30 μm or less; and an external additive. The toner particles and the cross-linked polyester resin particles are externally treated with the external additive in the same manner.

7 Claims, 2 Drawing Sheets

DEVELOPER, METHOD FOR FORMING IMAGE, AND METHOD FOR PRODUCING DEVELOPER

INCORPORATION BY REFERENCE

The present application claims priority under 35 U.S.C. §119 to Japanese Patent Application No. 2013-165224, filed Aug. 8, 2013. The contents of this application are incorporated herein by reference in their entirety.

BACKGROUND

The present disclosure relates to developers. The present disclosure further relates to methods for forming images with the use of the developers and methods for producing the developers.

Image forming methods such as electrophotographic image forming methods include the following operations. That is, a surface of an electrostatic latent image bearing member such as a photosensitive drum is charged by corona discharge, for example. Then, the surface of the electrostatic latent image bearing member is exposed using an exposing device such as a laser to form an electrostatic latent image. The electrostatic latent image is developed with toner particles into a toner image. The toner image is transferred to a recording medium (e.g., paper). Then, the image transferred is fixed to the recording medium with a heat roller, for example, to form an image. The toner particles that are used in the image forming methods each contain a binder resin and a magnetic material, for example. Examples of the binder resin include thermoplastic resins. Such toner particles are charged with a specified amount of charge.

The toner particles are likely to cause filming on the surface of the electrostatic latent image bearing member (image bearing member). In order to prevent the filming, a method for polishing the surface of the image bearing member has been considered.

SUMMARY

A developer of the present disclosure contains: toner particles each containing a binder resin and a magnetic powder; cross-linked polyester resin particles having a particle size of 2 μm or more and 30 μm or less; and an external additive. The toner particles and the cross-linked polyester resin particles are externally treated with the external additive in the same manner.

A method for forming an image of the present disclosure includes use of the developer. The method for forming an image of the present disclosure includes scraping. The scraping is to scrape off the toner particles and the cross-linked polyester resin particles remaining on a surface of an image bearing member using a cleaning member after image transfer.

A method for producing a developer of the present disclosure includes preparing and externally treating. The preparing is to prepare a particulate mixture by mixing toner particles each containing a binder resin and a magnetic powder with cross-linked polyester resin particles having a particle size of 2 μm or more and 30 μm or less. The externally treating is to externally treat the particulate mixture with an external additive.

DETAILED DESCRIPTION

The following describes embodiments of the present disclosure in detail. The present disclosure is in no way limited to the embodiments below, and various alterations may be made to practice the present disclosure within the scope of the aim of the present disclosure. It should be noted that some overlapping explanations may be omitted. Such omission, however, is not intended to limit the gist of the disclosure.

A developer of the present disclosure contains: toner particles each containing a binder resin and a magnetic powder; cross-linked polyester resin particles having a particle size of 2 μm or more and 30 μm or less; and an external additive. The developer of the present disclosure can be used in an electrophotographic image forming method, for example.

Figure 1:
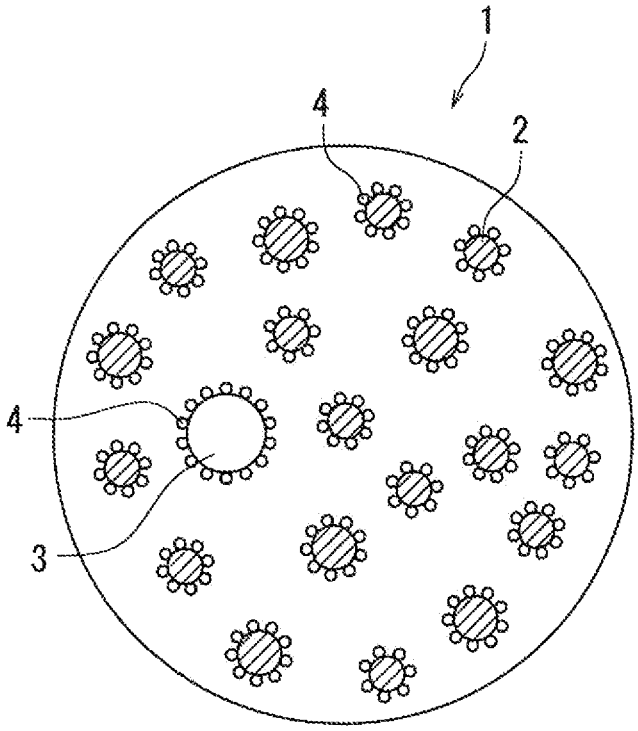
FIG. 1 is a schematic view of a developer of an embodiment of the present disclosure.

Hereinafter, a structure of the developer of the present disclosure will be described with reference to FIG. 1. A developer 1 of the present disclosure contains toner particles 2 and cross-linked polyester resin particles 3 that are mixed together. An external additive 4 is added and attached to surfaces of the toner particles 2 and the cross-linked polyester resin particles 3. The external additive 4 is made from particles having a particle size smaller than the toner particles 2 and the cross-linked polyester resin particles 3.

The type of the binder resin is not particularly limited and may be determined as appropriate. Specific examples of the binder resin include thermoplastic resins (e.g., styrene-based resins, acrylic-based resins, styrene-acrylic-based copolymers, polyethylene-based resins, polypropylene-based resins, vinyl chloride-based resins, polyester-based resins, polyamide-based resins, polyurethane-based resins, polyvinyl alcohol-based resins, vinyl ether-based resins, N-vinyl-based resins, or styrene-butadiene-based resins).

As the magnetic powder, a known magnetic powder may be used. Specific examples of the magnetic powder include metals or alloys of ferromagnetic elements (e.g., ferrite, magnetite, iron, cobalt, or nickel); compounds containing one or more of the ferromagnetic elements; and alloys that are free from the ferromagnetic elements and can become ferromagnetic when given an appropriate heat treatment.

A sufficiently colored magnetic powder can serve as a colorant for the toner particles 2. In this case, therefore, no colorant needs to be added to the toner particles 2.

The particle size (average particle size) of the magnetic powder is not particularly limited, and is preferably 0.1 μm or more and 1.0 μm or less, and more preferably 0.1 μm or more and 0.5 μm or less.

A content of the magnetic powder in the toner particles 2 is preferably 1 part by mass or more and 60 parts by mass or less, and more preferably 20 parts by mass or more and 50 parts by mass or less relative to 100 parts by mass of the toner particles.

If the toner particles 2 are not sufficiently colored with the magnetic powder, a known colorant may be added to the toner particles 2. Specific examples of the colorant include black pigments (carbon black, acetylene black, lamp black, or aniline black), yellow pigments (chrome yellow, zinc chromate, cadmium yellow, yellow iron oxide, mineral fast yellow, nickel titan yellow, Naples yellow, naphthol yellow S, Hansa yellow G, Hansa yellow 10G, benzidine yellow G, benzidine yellow GR, quinoline yellow lake, permanent yellow NCG, or tartrazine lake), orange pigments (chrome orange, molybdenum orange, permanent orange GTR, pyrazolone orange, Vulcan orange, or indanthrene brilliant orange GK), red pigments (red iron oxide, cadmium red, red lead, mercury sulfide cadmium, permanent red 4R, lithol red, pyrazolone red, watching red calcium salt, lake red D, brilliant carmine 6B, eosin lake, rhodamine lake B, alizarin lake, or brilliant carmine 3B), violet pigments (manganese purple, fast violet B, or methyl violet lake), blue pigments (Prussian blue, cobalt blue, alkali blue lake, partial chloride of Victorian blue, fast sky blue, or indanthren blue BC), green pigments (chrome green, chrome oxide, pigment green B, malachite green lake, or final yellow green G), white pigments (zinc flower, titanium oxide, antimony white, or zinc sulfide), and extender pigments (barite powder, barium carbonate, clay, silica, white carbon, talc, or alumina white).

As needed, other additives such as a charge control agent or a mold releasing agent may be contained in (included in or internally added to) the toner particles 2 within a range not impairing the effect of the present disclosure.

The charge control agent is added in order to enhance the charge level or the charge rise characteristics and obtain excellent durability or stability. The toner particles 2 that the developer 1 provides for development are positively charged. Accordingly, the charge control agent to be added can be a positive charge control agent.

Examples of the positive charge control agent include azine compounds (pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, or quinoxaline), direct dyes made from an azine compound (azine fast red FC, azine fast red 12BK, azine violet BO, azine brown 3G, azine light brown GR, azine dark green BH/C, azine deep black EW, or azine deep black 3RL), nigrosine compounds (nigrosine, nigrosine salts, or nigrosine derivatives), acid dyes made from a nigrosine compound (nigrosine BK, nigrosine NB, or nigrosine Z), metal salts of naphthenic acids and metal salts of higher fatty acids, alkoxylated amines, alkylamides, and quaternary ammonium salts (benzyldecylhexylmethylammonium chloride or decyltrimethylammonium chloride). In addition, resins or oligomers including a quaternary ammonium salt, a carboxylate salt, or a carboxyl group as a functional group are also usable as the positive charge control agent. These charge control agents may be used independently, or two or more of the charge control agents may be used in combination.

The mold releasing agent is added for the purpose of enhancing fixability or offset resistance. A wax is preferred as the mold releasing agent. Examples of the wax include polyethylene waxes, polypropylene waxes, fluororesin-based waxes, Fischer-Tropsch waxes, paraffin waxes, and ester waxes. Of these waxes, ester waxes are preferred because they are easily reduced in diameter when dispersed in the binder resin, have a relatively low melting point, and are superior in fixability. Examples of the ester waxes include natural waxes made from plant-derived materials (candelilla wax, carnauba wax, rice wax, Japan wax, and jojoba wax), synthetic ester waxes produced through chemical synthesis, and montan waxes extracted from brown coal with a solvent. These waxes may be used independently, or two or more of the waxes may be used in combination.

The particle size (average particle size) of the toner particles 2 is preferably 5 μm or more and 12 μm or less, and more preferably 6 μm or more and 11 μm or less.

The toner particles 2 can be prepared by a known toner preparation method. First, for example, the binder resin, the magnetic powder, and the additives as needed are sufficiently mixed under stirring using a mixer (e.g., an FM mixer or a ball mill). Then, the mixture is melt-kneaded using a heat kneading machine (e.g., a heat roll, a kneader, or an extruder), and then solidified under cooling. Subsequently, the solidified product is pulverized and classified thereby to give the toner particles 2.

Hereinafter, the cross-linked polyester resin particles 3 will be described.

The cross-linked polyester resin particles 3 contain, as a main component, a polyester resin cross-linked with a cross-linking monomer. The polyester resin is highly negatively chargeable. When used for image formation, therefore, the cross-linked polyester resin particles 3 land on an unexposed part of the surface of the positively charged image bearing member (a part to which the toner particles 2 are not attached because of remaining presence of positive charges and which therefore becomes a non-imaged portion). Since the cross-linked polyester resin particles 3 are not transferred to a recording medium (e.g., paper), the particles act as an abrasive on the non-imaged portion. In addition, the polyester resin particles 3 are very hard as being cross-linked. Accordingly, the cross-linked polyester resin particles 3 exhibit excellent polishing characteristics (cleaning characteristics) to the image bearing member in image formation. Furthermore, the cross-linked polyester resin particles 3 produce a significant effect of reducing offset when a heat roll is used for fixing an image transferred to a recording medium, for example. The cross-linked polyester resin particles 3 are externally treated with an external additive in the same manner as in the toner particles 2. Accordingly, the cross-linked polyester resin particles 3 have excellent fluidity and handling characteristics as well as excellent polishing characteristics.

A dihydric alcohol component or a dibasic acid component mentioned below may be used as a monomer component of the polyester resin. Examples of the dihydric alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol. Furthermore, the dihydric alcohol component may be derivatized.

Examples of the dibasic acid component include dicarboxylic acids and derivatives thereof. Examples of the dicarboxylic acids and derivatives thereof include benzene dicarboxylic acids (phthalic acid, terephthalic acid, isophthalic acid, or phthalic anhydride), anhydrides thereof, and lower alkyl esters thereof; alkyl dicarboxylic acids (succinic acid, adipic acid, sebacic acid, or azelaic acid), anhydrides thereof, and lower alkyl esters thereof; alkenyl succinic acids (n-dodecenyl succinic acid) and alkyl succinic acids (n-dodecyl succinic acid), anhydrides thereof, and lower alkyl esters thereof; and unsaturated dicarboxylic acids (fumaric acid, maleic acid, citraconic acid, or itaconic acid), anhydrides thereof, and lower alkyl esters thereof. 9Z Examples of the cross-linking monomer for cross-linking the polyester resin include a trihydric or higher-hydric alcohol component and a tribasic or higher-basic acid component. Preferably, these components are used in combination from the viewpoint of satisfactory cross-linking.

Examples of the trihydric or higher-hydric alcohol component include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the tribasic or higher-basic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,3,4-butanetetracarboxylic acid, 1,2,7,8-octanetetracarboxylic acid; and Empol trimer acid. The tribasic or higher-basic acid may be an anhydride or a lower alkyl ester, and may be derivatized.

The cross-linked polyester resin is obtained through polymerization of the above-mentioned monomer components (dihydric alcohol component, dibasic acid component, and cross-linking monomer) by an appropriate polymerization method and under appropriate polymerization conditions. A known polymerization catalyst may be used in the polymerization.

The cross-linked polyester resin as described above is melt-kneaded using a heat kneading machine such as a kneader or an extruder. Subsequently, the cross-linked polyester resin is solidified under cooling, and then pulverized and classified to give the cross-linked polyester resin particles 3.

The cross-linked polyester resin particles 3 have a particle size (average particle size) of 2 μm or more and 30 μm or less. In particular, the particle size of the cross-linked polyester resin particles 3 is preferably 4 μm or more and 15 μm or less, and more preferably 6 μm or more and 10 μm or less. If the cross-linked polyester resin particles 3 have a particle size outside the range of 6 μm or more and 10 μm or less, the developer 1 to be obtained will exhibit poor polishing characteristics on a part of the surface of the image bearing member to be a non-imaged portion. A discharge product generated during the charging remains attached to a part insufficiently polished. Consequently, the discharge product and water in the air may bind together in a high-humidity environment. In this case, the resistance of the surface of the image bearing member is reduced to be unable to maintain a latent image. Thus, the cross-linked polyester resin particles 3 having a particle size outside the above-specified range may cause an image defect (e.g., image deletion) when used in image formation.

A content percentage of the cross-linked polyester resin particles 3 in the developer 1 is preferably 0.5% by number or more and 5.0% by number or less, more preferably 2% by number or more and 4.5% by number or less, and still more preferably 3% by number or more and 4% by number or less relative to the total number of the toner particles 2 and the cross-linked polyester resin particles 3. The cross-linked polyester resin particles 3 having a content percentage of more than 0.5% by number allow the developer 1 to exhibit excellent polishing characteristics to the non-imaged portion of the surface of the image bearing member. The cross-linked polyester resin particles 3 having a content percentage of 5.0% by number or less can prevent a layer of the toner particles on the image bearing member from being locally thick in image formation, thereby reducing layer turbulence. A method for measuring the content percentage (% by number) of particles will be described in detail in the later-described examples. The layer turbulence refers to a phenomenon described as formation of an unnecessary image on a blank paper portion of an image formed when too many oppositely-charged particles (cross-linked polyester resin particles 3) exist. The phenomenon is caused because a layer formed from the toner particles 2 on a surface of a development roller for supplying the developer 1 to the image bearing member is partially thickened because of occurrence of charge agglomeration between the oppositely-charged particles and the toner particles, and therefore agglomerated particles depart from the thus thickened toner layer and land on the image bearing member.

The degree of cross-linking of the cross-linked polyester resin particles 3 can be determined based on the gel fraction as an index. The gel fraction is preferably 80% or higher, and more preferably 85% or higher. When the gel fraction is 80% or higher, a cross-linking effect can be produced to enhance the polishing characteristics or the offset resistance. The gel fraction is measured as follows, for example. The cross-linked polyester resin is dissolved in an appropriate solvent, and a portion remaining undissolved (cross-linked portion) is taken as a gel. The gel fraction is determined from a ratio (percentage) between the mass of the gel portion and the mass of the cross-linked polyester resin before the dissolution.

The toner particles 2 and the cross-linked polyester resin particles 3 in the developer 1 are externally treated with the same external additive 4 in the same manner. The treatment with the external additive can enhance fluidity or preservability of the toner particles 2 and the cross-linked polyester resin particles 3. The treatment with the external additive can also give the polishing characteristics to the toner particles 2, prevent occurrence of filming on the surface of the image bearing member, and enhance the cleaning characteristics. The treatment with the external additive can be performed by stirring the toner particles 2, the cross-linked polyester resin particles 3, and the external additive 4 together using an apparatus such as an FM mixer or a homogenizer, for example.

If the surfaces of the toner particles 2 and the cross-linked polyester resin particles 3 are not externally treated with the same external additive and in the same manner, there may be variances in the fluidity and the polishing characteristics between the toner particles 2 and the cross-linked polyester resin particles 3. As a result, the developer 1 to be obtained has poor polishing characteristics, causing a defect such as image deletion in image formation. If the toner particles 2 are not externally treated with the external additive, the toner particles 2 cannot be given the polishing characteristics, and therefore the polishing on an imaged portion of the surface of the image bearing member may be insufficient.

Examples of the external additive 4 include fine particles of inorganic oxides (titanium oxide, silica, zirconium oxide, aluminum oxide, or zinc oxide). The external additive 4 may be surface-treated with silicone oil, a silane coupling agent, or a titanate coupling agent, for example, for the purpose of further enhancing the fluidity, the preservability, or the chargeability of the toner particles 2 and the cross-linked polyester resin particles 3. Preferably, the external additive 4 has a particle size of 0.01 μm or more and 1.0 μm or less.

The amount of the external additive to be given to the toner particles 2 and the cross-linked polyester resin particles 3 is preferably 0.1 parts by mass or more and 10.0 parts by mass or less, and more preferably 0.2 parts by mass or more and 5.0 parts by mass or less relative to 100 parts by mass of the total amount of the toner particles 2 and the cross-linked polyester resin particles 3.

In terms of the developer 1, the external additive 4 attached to the surfaces of the toner particles 2 acts as an abrasive on the imaged portion of the surface of the image bearing member to which the positively charged toner particles 2 are supplied. Meanwhile, the negatively charged cross-linked polyester resin particles 3 which are hard and to which the external additive 4 is attached act as an abrasive on the non-imaged portion of the surface of the image bearing member on which the cross-linked polyester resin particles 3 land. The developer 1 is therefore able to exhibit excellent polishing characteristics not only on the imaged portion but also on the non-imaged portion of the surface of the image bearing member and reduce occurrence of image defects.

According to the method for producing the developer 1 of the present disclosure, the toner particles 2 and the cross-linked polyester resin particles 3 are mixed together to give a particulate mixture first. Then, the particulate mixture is externally treated with the external additive 4.

For preparing the particulate mixture, a binder resin and a magnetic powder are mixed together to give a mixture first. The mixture is melt-kneaded, and then pulverized and classified to give the toner particles 2. Next, the cross-linked polyester resin particles 3 are blended with the toner particle 2 to give the particulate mixture (preparation method 1).

The following method may be also mentioned as a method for preparing the particulate mixture. That is, a binder resin, a magnetic powder, and a cross-linked polyester resin are mixed together to give a mixture. The mixture is melt-kneaded, and then pulverized to give the particulate mixture of the toner particles 2 and the cross-linked polyester resin particles 3 (preparation method 2).

When the preparation method 1 is employed, the particle size of the toner particles 2 and the particle size of the cross-linked polyester resin particles 3 can be controlled so as to be different from each other. When the preparation method 2 is employed, on the other hand, the particulate mixture can be prepared in one stage, and a developer having a higher offset reducing effect can be obtained.

The above-mentioned components can be mixed together using a mixer such as an FM mixer or a ball mill. The mixture can be melt-kneaded using a heat kneading machine such as a heat roll, a kneader, or an extruder. Examples of the pulverization method include those using a pulverizer such as a ball mill. Particles obtained through the pulverization can be classified by air classification, for example. The cross-linked polyester resin particles 3 are lightweight, and therefore the air flow rate may be adjusted so that the cross-linked polyester resin particles 3 are not eliminated through the classification.

Hereinafter, a method for forming an image with the use of the developer 1 of the present disclosure will be described.

Figure 2:
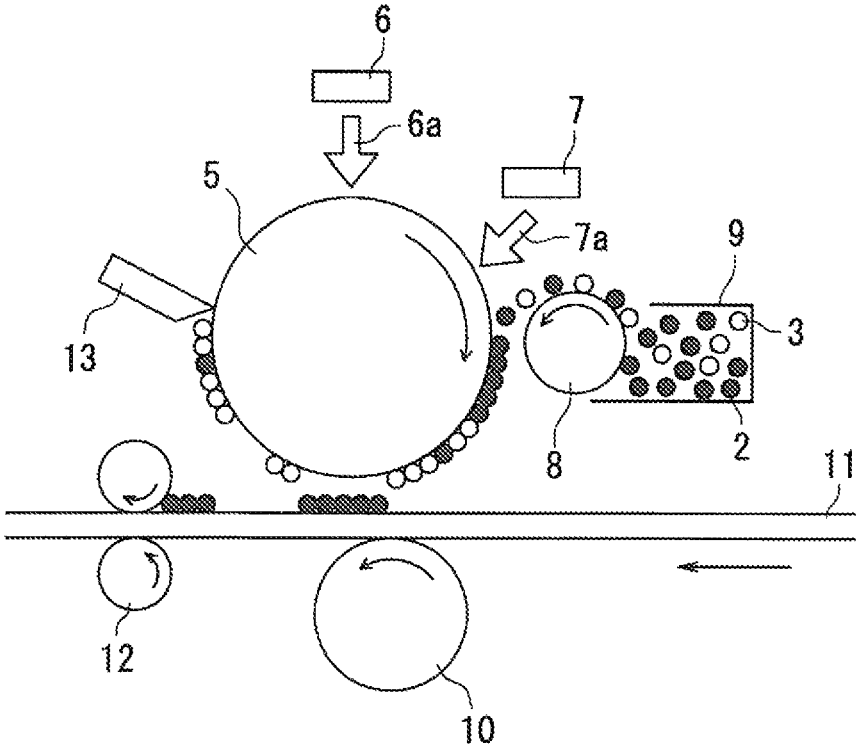
FIG. 2 is a diagram showing an image bearing member and its neighbor in an image forming apparatus for achieving a method for forming an image of an embodiment of the present disclosure.

FIG. 2 is a diagram showing an image bearing member and its neighbor in an image forming apparatus for achieving the method for forming an image of the present disclosure. The method for forming an image with the use of the developer 1 will be described in detail with reference to FIGS. 1 and 2. The method for forming an image of the present embodiment includes scraping. In the scraping, the toner particles 2 and the cross-linked polyester resin particles 3 remaining on the surface of the image bearing member are scraped off using a cleaning member after completion of image transfer. Preferably, the method for forming an image of the present disclosure includes preparing the developer 1, exposing, developing, and transferring in addition to the scraping, in particular. The exposing is to expose the surface of the charged image bearing member to form an electrostatic latent image on the surface of the image bearing member. The developing is to develop the electrostatic latent image into a toner image by supplying the developer 1 to the surface of the image bearing member having the electrostatic latent image formed. The transferring is to transfer the toner image from the image bearing member to a recording medium to form an image.

In the preparing the developer 1, specifically, the preparation method 1 or the preparation method 2 may be employed. The developer 1 may be contained in a developing device 9.

Next, in the exposing, a surface of a charged image bearing member 5 is exposed to form an electrostatic latent image on the surface of the image bearing member 5. Specifically, the surface of the image bearing member 5 is first positively charged using a charger 6 (e.g., a device employing corona discharge) (processing 6*a*). Then, a part of the surface of the image bearing member 5 positively charged is exposed using an exposure device 7 such as a laser (processing 7*a*), so that the part of the surface is electrically neutral. Thus, a part having no positive charges remaining (exposed portion) is defined, thereby forming an electrostatic latent image on the surface of the image bearing member 5. A part that has not gone through the processing 7*a* and remains positively charged is also referred to as non-exposed portion.

In the developing, the developer 1 is supplied to the surface of the image bearing member having the electrostatic latent image formed to develop the electrostatic latent image into a toner image. Specifically, the developer 1 is supplied from the developing device 9 to the surface of the image bearing member 5 via a development roller 8. The exposed portion of the surface of the image bearing member 5 attracts the toner particles 2 in the developer 1 to form a toner image. The method for forming an image of the present disclosure includes use of the developer 1. Being positively charged, the toner particles 2 contained in the developer 1 are supplied to the exposed portion. The portion to which the toner particles 2 are attached constitutes an imaged portion. Being negatively charged, on the other hand, the cross-linked polyester resin particles 3 contained in the developer 1 are attracted by the non-exposed portion (non-imaged portion).

In the transferring, the toner image formed in the developing is transferred from the image bearing member 5 to a recording medium 11 to form an image. Specifically, the toner particles 2 are transferred to the recording medium 11 such as paper using a transfer roller 10. On this occasion, not all the toner particles 2 are transferred to the recording medium 11. That is, a small amount of the toner particles 2 remain on the surface of the image bearing member 5.

In the scraping, the toner particles 2 and the cross-linked polyester resin particles 3 remaining on the surface of the image bearing member 5 are scraped off using a cleaning member 13 after completion of the transferring. Specifically, the toner particles 2 and the cross-linked polyester resin particles 3 remaining on the peripheral surface of the image bearing member 5 after completion of the transfer of the toner image are scraped off using the cleaning member 13 (e.g., a cleaning blade or a cleaning brush). The surface of the imaged portion of the image bearing member 5 is polished and cleaned by the external additive 4 (not shown in FIG. 2) attached to the surfaces of the toner particles 2 under pressed contact of the cleaning member 13 with the image bearing member 5. At the same time, the surface of the non-imaged portion of the image bearing member 5 is polished by the hard cross-linked polyester resin particles 3 under pressed contact of the cleaning member 13 with the image bearing member 5. That is, the method for forming an image with the use of the developer 1 can sufficiently polish and clean both the imaged portion and the non-imaged portion.

The peripheral surface of the image bearing member 5 subjected to the cleaning (i.e., subjected to the scraping) is then charged again.

After the image transfer, the toner particles 2 are fixed to the recording medium 11 through the fixing with heat or the like performed on the recording medium 11 passing through a fixing device 12 (e.g., a heating roller and a pressure roller).

Preferably, the method for forming an image of the present disclosure includes suspending exposure when the coverage rate on a surface of the recording medium 11 is 80% or higher. The suspending exposure is not to perform the exposure for an area corresponding to one sheet of paper (i.e., to provide a non-exposed area corresponding to one sheet of paper) in order to encourage the cross-linked polyester resin particles 3 to land on the surface of the image bearing member 5. When the coverage rate on the surface of the recording medium 11 is 80% or higher, a large amount of the positively charged toner particles 2 are attached to the surface of the image bearing member 5. Accordingly, the negatively charged cross-linked polyester resin particles 3 cannot easily land on the surface of the image bearing member 5. As a result, the cross-linked polyester resin particles 3 are likely to accumulate in the developing device 9. In order to encourage the cross-linked polyester resin particles 3 to land on the surface of the image bearing member 5, therefore, the suspending exposure is performed to increase the non-imaged portion. Thus, more cross-linked polyester resin particles 3 are actively consumed, landing on the surface of the image bearing member 5. Consequently, a sufficient amount of the cross-linked polyester resin particles 3 can land on the non-imaged portion without accumulating in the developing device 9. Thus, the non-imaged portion can also be satisfactorily cleaned by polishing. Specific embodiments of the suspending exposure include a method in which the image bearing member 5 is charged over a period of time equal to a period of time taken for forming an image having a size of one sheet of paper, and then the exposing is suspended, when printing with a coverage rate of 80% or higher on consecutive 100 sheets of paper is executed, for example.

The coverage rate A is calculated according to the following equation.

$$\text{Coverage rate } A\ (\%)=(a/b)\times 100$$

In the equation, "a" represents the area of a region of the surface of the recording medium 11 on which an image is actually formed. "b" represents the area of a region of the surface of the recording medium 11 on which an image can be formed.

EXAMPLES

The following more specifically describes the present disclosure by way of examples. The present disclosure is in no way limited to the examples.

[Preparation of Polyester Resin]

Non-Cross-Linked Polyester Resin i

To a two-liter four-necked flask, 50% by mol of bisphenol A (2,2-bis(4-hydroxyphenyl)propane) and 50% by mol of succinic acid were added. The flask was equipped with a thermometer, a stainless steel stirrer, a glass nitrogen gas inlet pipe, and a falling-type condenser. The flask was set in a mantle heater. Then, nitrogen gas was introduced into the flask through the glass nitrogen gas inlet pipe. The temperature within the flask was raised up to 230° C. while an inert atmosphere was maintained within the flask with the nitrogen gas. A polymerization reaction was allowed to proceed under the same conditions. If there is a loss in the amount of the monomers (starting monomers) through their scattering or sublimation, for example, the monomers were supplied into the flask so as to make up for the loss. A sample of the reaction system was collected at times as appropriate to determine the acid value of the polymerization reaction product. The polymerization reaction was terminated when the acid value reached 5 mgKOH/g. The resulting reaction product was taken out to a tray and cooled to room temperature to give the non-cross-linked polyester resin i. The non-cross-linked polyester resin i had a gel fraction of 0% by mass.

Cross-Linked Polyester Resin ii

The cross-linked polyester resin ii was obtained in the same manner as in the preparation of the non-cross-linked polyester resin i except that 50% by mol of bisphenol A, 30% by mol of terephthalic acid, and 20% by mol of 1,2,3,4-butanetetracarboxylic acid were used as starting monomers. The cross-linked polyester resin ii had a gel fraction of 80% by mass.

Non-Cross-Linked Polyester Resin iii

The non-cross-linked polyester resin iii was obtained in the same manner as in the preparation of the non-cross-linked polyester resin i except that 50% by mol of bisphenol A and 50% by mol of terephthalic acid were used as starting monomers. The non-cross-linked polyester resin iii had a gel fraction of 0% by mass.

Cross-Linked Polyester Resin iv

The cross-linked polyester resin iv was obtained in the same manner as in the preparation of the non-cross-linked polyester resin i except that 50% by mol of bisphenol A, 20% by mol of succinic acid, and 30% by mol of 1,2,3,4-butanetetracarboxylic acid were used as starting monomers. The cross-linked polyester resin iv had a gel fraction of 90% by mass.

Cross-Linked Polyester Resin v

The cross-linked polyester resin v was obtained in the same manner as in the preparation of the non-cross-linked polyester resin i except that 50% by mol of bisphenol A, 25% by mol of succinic acid, and 25% by mol of pyromellitic acid were used as starting monomers. The cross-linked polyester resin v had a gel fraction of 84% by mass.

[Preparation of Polyester Resin Particles]

Cross-Linked Polyester Resin Particles a

The cross-linked polyester resin ii was coarsely pulverized using a Rotoplex pulverizer (product by Hosokawa Micron Corporation), and then further pulverized using Turbo Mill (model number: "T-250", product by MATSUBO Corporation) at a rotation speed of 6000 rpm. Thereafter, air classification was performed using a classifier (model number: "EJ-L-3", product by MATSUBO Corporation) to give cross-linked polyester resin particles A having a number average particle size of 8.3 μm.

Cross-Linked Polyester Resin Particles B

The cross-linked polyester resin particles B having a maximum particle size of 1.9 μm were prepared in the same manner as in the preparation of the cross-linked polyester resin particles A except that the cross-linked polyester resin ii was pulverized to have a smaller particle size by changing the rotation speed of the Turbo Mill to 10000 rpm, and the classification was repeated with collecting fine powder in every classification.

Cross-Linked Polyester Resin Particles C

The cross-linked polyester resin particles C having a minimum particle size of 30.2 μm were prepared in the same manner as in the preparation of the cross-linked polyester resin particles A except that the cross-linked polyester resin ii was pulverized to have a larger particle size by changing the rotation speed of the Turbo Mill to 3000 rpm, and the classification was repeated with collecting fine powder in every classification.

Non-Cross-Linked Polyester Resin Particles D

The non-cross-linked polyester resin particles D having a number average particle size of 7.6 μm were prepared in the same manner as in the preparation of the cross-linked polyester resin particles A except that the non-cross-linked polyester resin iii was used instead of the cross-linked polyester resin ii, and the rotation speed of the Turbo Mill was changed to 4800 rpm.

Cross-Linked Polyester Resin Particles E

The cross-linked polyester resin particles E having a number average particle size of 2.8 μm were prepared in the same manner as in the preparation of the cross-linked polyester resin particles A except that the cross-linked polyester resin ii was pulverized at a rotation speed of the Turbo Mill changed to 9600 rpm, and the classification was repeated with collecting fine powder in every classification.

Cross-Linked Polyester Resin Particles F

The cross-linked polyester resin particles F having a number average particle size of 28.5 μm were prepared in the same manner as in the preparation of the cross-linked polyester resin particles A except that the cross-linked polyester resin ii was pulverized to have a larger particle size by changing the rotation speed of the Turbo Mill to 3500 rpm, and the classification was repeated with collecting fine powder in every classification.

Cross-Linked Polyester Resin Particles G

The cross-linked polyester resin particles G having a number average particle size of 8.8 μm were prepared in the same manner as in the preparation of the cross-linked polyester resin particles A except that the cross-linked polyester resin ii was changed to the cross-linked polyester resin iv, and the rotation speed for the pulverization was changed to 6500 rpm.

Cross-Linked Polyester Resin Particles H

The cross-linked polyester resin particles H having a number average particle size of 8.6 μm were prepared in the same manner as in the preparation of the cross-linked polyester resin particles G except that the cross-linked polyester resin iv was changed to the cross-linked polyester resin v.

Preparation of Toner Particles a

The following components were mixed under stirring using an FM mixer ("FM-20B", product by Nippon Coke & Engineering Co., Ltd.)

| | |
|---|---|
| Non-cross-linked polyester resin i | 47% by mass |
| Charge control agent ("FAC-207P", product by FUJIKURA KASEI CO., LTD.) | 5% by mass |
| Magnetic powder (magnetite "TN-15", product by MITSUI MINING & SMELTING CO., LTD) | 45% by mass |
| Mold releasing agent ("WEP-3", product by NOF Corporation) | 3% by mass |

Subsequently, the resulting mixture was melt-kneaded using a twin-screw extruder ("TEM-265S", product by Toshiba Machine Co. Ltd.), coarsely pulverized using a Rotoplex pulverizer (product by Hosokawa Micron Corporation), and then further pulverized using Turbo Mill (model number: "T-250", product by MATSUBO Corporation). The pulverized product was subjected to air classification using a classifier (model number: "EJ-L-3", product by MATSUBO Corporation) to give the toner particles a having an average particle size of 7.8 μm.

Example 1

The cross-linked polyester resin particles A were added to the toner particles a so that the content percentage of the cross-linked polyester resin particles A in a developer to be obtained would be 3.2% by number to give a particulate mixture. To 100 parts by mass of the particulate mixture, 0.8 parts by mass of silica fine particles ("RA200", product by Nippon Aerosil Co., Ltd.) and 1.0 parts by mass of titanium oxide particles (product by Titan Kogyo, Ltd.) were added and mixed under stirring using an FM mixer to coat (externally treat) the particles with the external additives. Thus, a developer of Example 1 was obtained.

Example 2

A developer of Example 2 was obtained in the same manner as in Example 1 except that the cross-linked polyester resin particles A were added to the toner particles a so that the content percentage of the cross-linked polyester resin particles A would be 0.5% by number.

Example 3

A developer of Example 3 was obtained in the same manner as in Example 1 except that the cross-linked polyester resin particles A were added to the toner particles a so that the content percentage of the cross-linked polyester resin particles A would be 5.0% by number.

Example 4

The following components were mixed under stirring using an FM mixer ("FM-20B", product by Nippon Coke & Engineering Co., Ltd.)

| | |
|---|---|
| Non-cross-linked polyester resin i | 42% by mass |
| Cross-linked polyester resin ii | 5% by mass |
| Charge control agent ("FAC-207P", product by FUJIKURA KASEI CO., LTD.) | 5% by mass |
| Magnetic powder (magnetite "TN-15", product by MITSUI MINING & SMELTING CO., LTD) | 45% by mass |
| Mold releasing agent ("WEP-3", product by NOF Corporation) | 3% by mass |

Subsequently, the resulting mixture was melt-kneaded using a twin-screw extruder ("TEM-26SS", product by Toshiba Machine Co. Ltd.), coarsely pulverized using a Rotoplex pulverizer (product by Hosokawa Micron Corporation), and then further pulverized using Turbo Mill (model number: "T-250", product by MATSUBO Corporation). The pulverized product was subjected to air classification using a classifier (model number: "EJ-L-3", product by MATSUBO Corporation). On that occasion, the air flow rate was reduced so that the lightweight cross-linked polyester resin particles would not be eliminated, and such classification was repeated to give a particulate mixture b of the toner particles and the cross-linked polyester resin particles.

To 100 parts by mass of the particulate mixture, 0.8 parts by mass of silica fine particles ("RA200", product by Nippon Aerosil Co., Ltd.) and 1.0 parts by mass of titanium oxide particles ("EC100", product by Titan Kogyo, Ltd.) were added and mixed under stirring using an FM mixer to coat (externally treat) the particles with the external additives. Thus, a developer of Example 4 was obtained. The toner particles in the developer had a number average particle size of 8.1 μm. The cross-linked polyester resin particles in the developer had a number average particle size of 9.5 μm. The content percentage of the cross-linked polyester resin particles in the developer obtained was 3.7% by number.

Example 5

The developer obtained in Example 3 was used as a developer of Example 5. Evaluation of image characteristics on Example 5 was performed in the same manner as in the later-described image characteristics evaluation performed on Example 3 except that an interval corresponding to one sheet of paper (non-exposed area in the suspending exposure) was provided every time an image was formed on five sheets of paper (size: A4) with the developer of Example 5 before the image is formed on subsequent paper.

Example 6

A developer of Example 6 was obtained in the same manner as in Example 1 except that the cross-linked polyester resin particles E were added to the toner particles a so that the content percentage of the cross-linked polyester resin particles E would be 0.6% by number.

Example 7

A developer of Example 7 was obtained in the same manner as in Example 1 except that the cross-linked polyester resin particles F were added to the toner particles a so that the content percentage of the cross-linked polyester resin particles F would be 0.5% by number.

Example 8

A developer of Example 8 was obtained in the same manner as in Example 1 except that the cross-linked polyester resin particles G were added to the toner particles a so that the content percentage of the cross-linked polyester resin particles G would be 2.9% by number.

Example 9

A developer of Example 9 was obtained in the same manner as in Example 1 except that the cross-linked polyester resin particles H were added to the toner particles a so that the content percentage of the cross-linked polyester resin particles H would be 3.1% by number.

Example 10

A developer of Example 10 was obtained in the same manner as in Example 1 except that the cross-linked polyester resin particles A were added to the toner particles a so that the content percentage of the cross-linked polyester resin particles A would be 0.4% by number.

Example 11

A developer of Example 11 was obtained in the same manner as in Example 1 except that the cross-linked polyester resin particles A were added to the toner particles a so that the content percentage of the cross-linked polyester resin particles A would be 5.2% by number.

Comparative Example 1

A developer of Comparative Example 1 was obtained in the same manner as in Example 1 except that the cross-linked polyester resin particles B were added to the toner particles a so that the content percentage of the cross-linked polyester resin particles B would be 3.3% by number.

Comparative Example 2

A developer of Comparative Example 2 was obtained in the same manner as in Example 1 except that the cross-linked polyester resin particles C were added to the toner particles a so that the content percentage of the cross-linked polyester resin particles C would be 2.8% by number.

Comparative Example 3

A developer of Comparative Example 3 was obtained in the same manner as in Example 1 except that the non-cross-linked polyester resin particles D were added to the toner particles a so that the content percentage of the non-cross-linked polyester resin particles D would be 3.1% by number.

Comparative Example 4

To 100 parts by mass of the toner particles a, 0.8 parts by mass of silica fine particles ("RA200", product by Nippon Aerosil Co., Ltd.) and 1.0 part by mass of titanium oxide particles ("EC100", product by Titan Kogyo, Ltd.) were added and mixed under stirring using the FM mixer to externally treat (coat) the particles with the external additives. Thereafter, the cross-linked polyester resin particles A were added thereto so that the content percentage thereof would be 3.0% by number, and the mixing under stirring was continued. That is, the cross-linked polyester resin particles A were not externally treated in the same manner as in the toner particles a.

Hereinafter, methods for evaluating the examples described in the present specification will be explained.

1. Abundance Ratio of Cross-Linked Polyester Resin Particles in Developer

Each developer obtained was placed on a microscope slide so as to form a single layer and observed with an optical microscope at a magnification of 500× or higher to 3000× or lower. In the developers obtained in the examples and comparative examples, the cross-linked polyester resin particles looked white since they are not colored, whereas the toner particles looked black since they contain magnetite. Then, the toner particles and the cross-linked polyester resin particles were counted using image analysis software ("Win ROOF", product by Mitani Corporation) so that the total number of the particles would be 10000 or more. Accordingly, the abundance ratio (% by number) of the cross-linked polyester resin particles to the total number of the toner particles and the cross-linked polyester resin particles was determined. As for Comparative Example 3, the abundance ratio was determined for the non-cross-linked polyester resin particles by counting the number thereof.

2. Particle Sizes of Toner Particles and Cross-Linked Polyester Resin Particles

The particle sizes were measured using image analysis software ("Win ROOF", product by Mitani Corporation). The particle sizes were averaged when a number average particle size was desired.

3. Evaluation of Image Characteristics

A developing device of a printer (a printer obtained by modifying "LS-4020DN (monochrome printer)", product by KYOCERA Document Solutions Inc.) was filled with 200 g of each developer obtained. In addition, a container was filled with the developer. Subsequently, image evaluations (3-1, 3-2, and 3-3) were performed by the later-described methods. The printer was equipped with an image bearing member and its peripheral device, and a cleaning member such as those shown in FIG. 2.

3-1. Evaluation of Layer Turbulence (Initial Stage)

Each developer obtained was set in the printer, and then blank paper was output. The presence or absence of layer turbulence on the blank paper portion and on the development roller was visually observed and evaluated according to the following criteria. Occurrence of the layer turbulence on the blank paper portion was evaluated by visually observing the presence or absence of fogging on the paper. In the cases where fogging was observed on the blank paper, the fogging was found to be occurring periodically in the paper conveyance direction every one round of the surface of the development roller.

(G) Good: Layer turbulence was not observed on either the blank paper portion or the development roller.

(A) Acceptable: Layer turbulence was not observed on the blank paper portion but observed on the development roller.

(NG) No good: Layer turbulence was observed on both the blank paper portion and the development roller.

3-2. Evaluation of Layer Turbulence (Long Term)

Each developer obtained was set in the printer, and a document with a coverage rate of 80% was printed on 2000 sheets of paper. Thereafter, blank paper was output, and the presence or absence of layer turbulence on the blank paper portion and on the development roller was visually observed and evaluated according to the following criteria.

(G) Good: Layer turbulence was not observed on either the blank paper portion or the development roller.

(A) Acceptable: Layer turbulence was not observed on the blank paper portion but observed on the development roller.

(NG) No good: Layer turbulence was observed on both the blank paper portion and the development roller.

3-3. Evaluation of Image Deletion

Five thousand sheets of paper were prepared, and a solid image in the shape of a longitudinal strip having a width of 2 cm was printed on a region 2 cm from the left end of each paper. Then, the image bearing member (photosensitive drum) in the printer was allowed to stand in an environment at 28° C. and 80% RH for 12 hours. Thereafter, a halftone image (50% image) was printed on the whole region of a sheet of paper in an environment at 28° C. and 80% RH, and the resulting image was visually observed. The image deletion was evaluated according to the following criteria.

(G) Good: The halftone image was completely printed.

(A) Acceptable: The halftone image was slightly blurred because of image deletion on the image bearing member.

(NG) No good: The halftone image was blurred because of image deletion on the image bearing member.

4. Offset Occurrence Temperature

The fixing temperature of the heat roller in the fixing section was set to rise in increments of 10° C. A solid image having a size of 2.5 cm×2.5 cm was consecutively printed on 10 sheets of paper, during which occurrence of offset on the heat roller was visually observed to determine a temperature at which offset occurred.

5. Gel Fraction of Polyester Resin (Degree of Cross-Linking)

The gel fraction of each polyester resin was measured by soxhlet extraction at 80° C. for 24 hours with methyl ethyl ketone as a solvent.

The developers obtained in the examples and the comparative examples were evaluated as described above. The evaluation results are shown in Table 1.

TABLE 1

| | Developers | | | | Evaluations | | | |
|---|---|---|---|---|---|---|---|---|
| | Toner particles | Cross-linked resin particles | Content percentage of cross-linked resin particles % by number | Number average particle size of cross-linked resin particles μm | Image deletion | Layer turbulence (initial stage) | Layer turbulence (durability) | Offset occurrence Temp. ° C. |
| Example 1 | a | A | 3.2 | 8.3 | G | G | G | 200 |
| Example 2 | a | A | 0.5 | 8.3 | G | G | G | 195 |
| Example 3 | a | A | 5.0 | 8.3 | G | G | A | 205 |
| Example 4 | b*1 | b*1 | 3.7 | 9.5 | G | G | G | 230 |
| Example 5 | a | A | 5.0 | 8.3 | G | G | G | 205 |
| Example 6 | a | E | 0.6 | 2.8 | G | G | G | 195 |
| Example 7 | a | F | 0.5 | 28.5 | G | G | G | 195 |
| Example 8 | a | G | 2.9 | 8.8 | G | G | G | 200 |
| Example 9 | a | H | 3.1 | 8.6 | G | G | G | 200 |
| Example 10 | a | A | 0.4 | 8.3 | A | G | A | 195 |
| Example 11 | a | A | 5.2 | 8.3 | G | A | G | 205 |
| Comparative Example 1 | a | B | 3.3 | 1.9*3 | NG | G | G | 200 |
| Comparative Example 2 | a | C | 2.8 | 30.2*4 | NG | G | G | 200 |
| Comparative Example 3 | a | D | 3.1 | 7.6 | NG | G | G | 195 |
| Comparative Example 4 | a | A*2 | 3.0 | 8.3 | NG | G | G | 195 |

*1The toner particles and the cross-linked polyester resin particles were prepared at the same time to give the particulate mixture.

*2The cross-linked polyester resin particles were not externally treated in the same manner as in the toner particles.

*3The maximum particle size was measured.

*4The minimum particle size was measured.

As obvious from Table 1, substantially no image deletion occurred, and substantially no layer turbulence occurred over a long period of time in the cases of the developers of the present disclosure obtained in Examples 1 to 11.

In the case of the developer obtained in Comparative Example 1, the cross-linked polyester resin particles had a too small particle size, and therefore the addition of the cross-linked polyester resin particles did not have an effect. Consequently, the resulting image was blurred. This is assumedly because image deletion occurred.

In the case of the developer obtained in Comparative Example 2, the cross-linked polyester resin particles had a too large particle size. Accordingly, image deletion occurred, and therefore the resulting image was blurred.

In the case of the developer obtained in Comparative Example 3, the non-cross-linked polyester resin particles were used instead of the cross-linked polyester resin particles. Accordingly, image deletion occurred, and therefore the resulting image was blurred.

In the case of the developer obtained in Comparative Example 4, the cross-linked polyester resin particles were not externally treated in the same manner as in the toner particles. Accordingly, image deletion occurred, and therefore the resulting image was blurred.

What is claimed is:

1. A developer comprising:

toner particles each containing a binder resin and a magnetic powder;

cross-linked polyester resin particles having a particle size of 2 μm or more and 30 μm or less; and an external additive, wherein the toner particles and the cross-linked polyester resin particles are externally treated with the external additive in the same manner.

2. A developer according to claim 1, wherein a content percentage of the cross-linked polyester resin particles is 0.5% by number or more and 5.0% by number or less relative to the total number of the toner particles and the cross-linked polyester resin particles.

3. A method for forming an image with the use of a developer according to claim 1, the method comprising:

scraping off the toner particles and the cross-linked polyester resin particles remaining on a surface of an image bearing member using a cleaning member after image transfer.

4. A method for forming an image according to claim 3, further comprising:

suspending exposure to provide a non-exposed area corresponding to one sheet of paper in order to encourage the cross-linked polyester resin particles to land on the surface of the image bearing member when a coverage rate on a surface of a recording medium is 80% or higher.

5. A method for producing a developer, comprising:

preparing a particulate mixture by mixing toner particles each containing a binder resin and a magnetic powder with cross-linked polyester resin particles having a particle size of 2 μm or more and 30 μm or less; and externally treating the particulate mixture with an external additive.

6. A method for producing a developer according to claim 5, wherein in the preparing, the toner particles are prepared by mixing the binder resin and the magnetic powder to give a mixture, and melt-kneading and then pulverizing the mixture, and the particulate mixture is prepared by blending the cross-linked polyester resin particles with the toner particles.

7. A method for producing a developer according to claim 5, wherein in the preparing, the particulate mixture is prepared by mixing the binder resin, the magnetic powder, and the cross-linked polyester resin particles to give a mixture, and melt-kneading and then pulverizing the mixture.

* * * * *